United States Patent [19]

Tanaka et al.

[11] Patent Number: 4,543,134

[45] Date of Patent: Sep. 24, 1985

[54] PROCESS FOR PRODUCING GRAIN-ORIENTED ELECTRICAL STEEL SHEET HAVING BOTH IMPROVED MAGNETIC PROPERTIES AND PROPERTIES OF GLASS FILM

[75] Inventors: Osamu Tanaka; Shozaburo Nakashima; Takashi Nagano; Tomoji Kumano; Yoshitaka Hiromae, all of Kitakyushu, Japan

[73] Assignee: Nippon Steel Corporation, Tokyo, Japan

[21] Appl. No.: 667,743

[22] Filed: Nov. 2, 1984

[30] Foreign Application Priority Data

Jan. 9, 1984 [JP] Japan ..... 59-810

[51] Int. Cl.[4] ..... H01F 1/04

[52] U.S. Cl. ..... 148/113; 148/27; 148/28

[58] Field of Search ..... 148/113, 27, 28

[56] References Cited

U.S. PATENT DOCUMENTS 3,841,925 10/1974 Steger ..... 148/113
4,168,189 9/1979 Haselkorn ..... 148/113
4,242,155 12/1980 Morito et al. ..... 148/113

FOREIGN PATENT DOCUMENTS 51-12451 4/1976 Japan .
54-143718 11/1979 Japan .
58-107417 6/1983 Japan ..... 148/113
59-56582 4/1984 Japan ..... 148/113

*Primary Examiner*—John P. Sheehan
*Attorney, Agent, or Firm*—Kenyon & Kenyon

[57] ABSTRACT

The present invention provides an annealing separator comprising from 0.05 to 2.0 parts by weight of antimony sulfate based on 100 parts by weight of magnesium oxide, and at least one chloride selected from the group consisting of Sb, Sr, Ti, and Zr chlorides in a chlorine amount of from 5 to 20% by weight based on 100% of the chloride and antimony sulfate, and occasionally comprises Ti oxide in an amount of from 0.5 to 10 parts.

The annealing separator is applied on the decarburization annealed strip, and improves both the magnetic properties and properties of glass film, in the production of a grain-oriented electrical steel sheet.

3 Claims, 1 Drawing Figure

PROCESS FOR PRODUCING GRAIN-ORIENTED ELECTRICAL STEEL SHEET HAVING BOTH IMPROVED MAGNETIC PROPERTIES AND PROPERTIES OF GLASS FILM

BACKGROUND OF THE INVENTION

1. Field of the Invention

The present invention relates to a process for producing a grain-oriented electrical steel sheet having both improved magnetic properties and properties of a glass film.

2. Description of the Prior Art

The grain-oriented electrical steel sheet is used as a core for transformers and other electrical machinery and apparatus. The magnetic properties required of the grain-oriented electrical steel sheet when used for the core are good excitation and watt loss.

The secondary recrystallization process by which grains having a (110) plane parallel to the rolling surface and an <001> axis in the rolling direction are developed, is utilized to produce the grain-oriented electrical steel sheet. The secondary recrystallized grains are referred to as the Goss texture. To develope the secondary recrystallized grains, a so-called inhibitor is used to inhibit the growth of primary recrystallized grains from occurring until the finishing annealing, more specifically until the stage at which the temperature is elevated to the annealing temperature for the secondary recrystallization. Known inhibitor include AlN, MnS, MnSe, and BN. At present a nitride inhibitor, such as AlN, a sulfide inhibitor, such as MnS, or both the nitride and sulfide inhibitors are mainly used. The inhibitor must be finely precipitated and dispersed in the steel, and must be neither dissolved nor varied in size up to a certain temperature region.

The starting material for producing the grain-oriented electrical steel sheet is Si-steel containing C and the inhibitor-forming elements. The Si content of the Si-steel is up to 4%. The Si-steel is first hot-rolled and then annealed if necessary, particularly when the AlN inhibitor is used. The hot-rolled strip is cold-rolled once or twice with an intermediate annealing. The cold-rolled strip having the final finishing thickness is decarburization-annealed and then subjected to the application of an annealing separator which is mainly composed of MgO. Then, the cold-rolled strip is finishing annealed. During the finishing annealing, the Goss texture is formed and, further, impurities such as N, S, etc. are removed from the steel into the glass film also formed during the finishing annealing. This glass film is an insulative film having a glass-like structure.

Recent strong trends toward energy conservation in the field of transformers and the like resulted in not only conventional studies of the inhibitor components but also studies of the glass film. Various proposals have been made with regard to the method for forming the glass film during the finishing annealing. For example, (a) Japanese Examined Patent Publication (Kokoku) No. 51-12451 describes a method for applying, to the sheet surface on which the $SiO_2$-containing insulating film is formed, the annealing separator which comprises, in addition to an Mg compound, from 2 to 40% of Ti compound; (b) Japanese Unexamined Patnet Publication (Kokai) No. 54-143718 describes an annealing separator which comprises mainly MgO, with the addition of an Sr-containing compound in an amount of from 0.1 to 10% in terms of metallic Sr, and, if necessary, a Ti compound in an amount of from 0.5 to 5% in terms of metallic Ti; and (c) Japanese Unexamined Patent Publication No. 58-107417 describes an annealing separator which comprises mainly MgO, and metallic Sb or an Sb compound in an amount of from 0.01 to 1.0%, the particle size of the Sb or Sb compound being 20 μm or less when the content of the particles is 70% or more.

The annealing separator (a) above allegedly improves the adherence of the glass film to the steel sheet, enhances the electric resistance between the glass film and the steel sheet, and mitigates the embrittlement of the steel sheet.

The annealing separator (b) above allegedly eliminates the forstellite grains present directly beneath the steel sheet surface and moves the forstellite grains upwards into the glass film, due to the effects of Sr, thereby improving the adherence of the glass film to the steel sheet.

The annealing separator (c) above allegedly reduces, due to effect of Sb, the diameter of the secondary recrystallized grains without impairing the orientation alignment of the secondary recrystallized grains.

SUMMARY OF THE INVENTION

The present invention is based on studies of the glass-film formation from the viewpoint of improving both the magnetic properties and the properties of the glass film.

The present inventors investigated the formation of the glass film and discovered that neither the magnetic properties or the properties of glass film are excellent according to the prior art.

An oxide film comprising $SiO_2$ is formed on the steel sheet during the decarburization annealing, and an annealing separator comprising MgO is applied on this steel sheet prior to the finishing annealing. The reaction between MgO and $SiO_2$ to form the glass film of forstellite occurs during the finishing annealing according to the following formula:

$$2MgO + SiO_2 \rightarrow Mg_2SiO_4.$$

In the light of the decarburization ability and productivity, the decarburization annealing is usually carried out under a thermodynamical condition, i.e., high dew-point and short annealing-period time to form fayalite. The oxide film of the decarburization-annealed steel sheet therefore mainly comprises the fayalite ($Fe_2SiO_4$) or fayalite ($Fe_2SiO_4$) and $SiO_2$, and occasionally comprises a small amount of iron oxide, such as FeO. The iron oxide such as FeO behaves as an oxygen source and generates during the finishing annealing an oxidizing matter between the coiled sections of steel sheet. As a result of the generation of the oxidizing matter, the magnetic properties are liable to be impaired, the formation of the glass film is detrimentally influenced, and the adhesive property and appearance of the glass film is impaired.

The present inventors further investigated the composition of the annealing separator.

The annealing separator discovered by the present inventors mainly comprises MgO and is characterized by further comprising $Sb_2(SO_4)_3$ and a chloride which is at least one selected from the group consisting of Sb, Sr, Ti, and Zr. The present invention is now explained with reference to the drawing.

DESCRIPTION OF THE PREFERRED EMBODIMENTS

Figure 1:
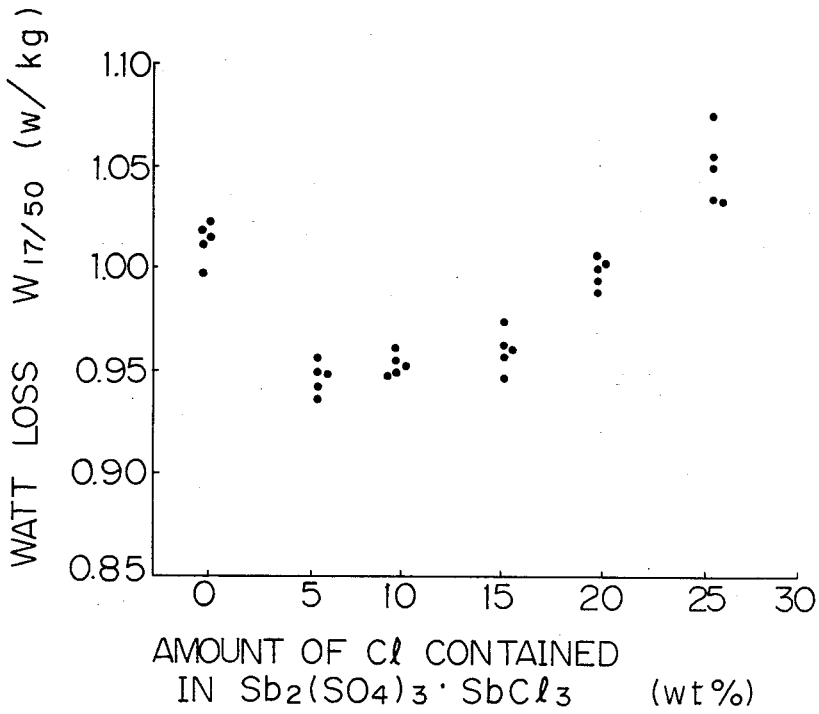
FIG. 1 is a graph illustrating a relationship between the watt loss $W_{17/50}$ and the amount of Cl in weight percentage contained in $Sb_2(SO_4)_3.SbCl_3$.

The watt loss $W_{17/50}$ shown in FIG. 1 is that found in a grain-oriented electrical steel sheet produced by the following process.

Slabs which contained from 0.045 to 0.060% of C, from 3.00 to 3.15% of Si, and from 0.025 to 0.030% of Al as the basic alloying elements were successively hot-rolled, annealed, and cold-rolled. The resulting 0.29 mm thick cold-rolled strips were decarburization annealed. The annealing separator was preliminarily prepared by incorporating, into 100 parts by weight of MgO, from 0.1 to 1.5 parts by weight of $Sb_2(SO_4)_3$, and Sb chloride ($SbCl_3$) in an amount shown in the abscissa of FIG. 1, was applied on the decarburization annealed strips, and then dried. The finishing annealing was then carried out at 1200° C. for 20 hours.

As is apparent from FIG. 1, the watt loss $W_{17/50}$ becomes low when an appropriate selection is made of the amount of Cl contained in the $Sb_2(SO_4)_3.SbCl_3$.

The properties of the glass film were investigated with regard to its appearance and adhesive property. It was discovered that the properties of the glass film were improved by appropriately selecting the amount of Cl contained in the $Sb_2(SO_4)_3.SbCl_3$.

In addition to Sb chloride, Sr chloride, Ti chloride, and Zr chloride were tested as an additive to MgO and found to attain improvements in both the magnetic properties and the properties of the glass film.

The present invention is based on the discoveries described above.

The essence of the process for producing a grain-oriented electrical steel sheet according to the present invention resides in that, on the surface of the decarburization annealed steel sheet having an oxide film comprising $SiO_2$ thereon, an annealing separator is applied comprising magnesium oxide, from 0.05 to 2.0 parts by weight of antimony sulfate incorporated to 100 parts by weight of magnesium oxide and from 5 to 20% by weight of at least one chloride selected from the group consisting of Sb, Sr, Ti, and Zr chlorides incorporated based on 100% by weight of the antimony sulfate and the chloride. The annealing separator is then dried, and the finishing annealing subsequently carried out.

The annealing separator can comprise, if necessary, from 0.5 to 10 parts by weight of a Ti oxide.

The antimony sulfate ($Sb_2(SO_4)_3$) and a chloride of Sb, Sr, Ti, and/or Zr contained in the glass film decrease the crystallization temperature of the forstellite, and lower the formation temperature of the glass film, with the result that the deterioration of the oxide film, particularly the $SiO_2$ layer, formed during the decarburization annealing can be prevented during the finishing annealing. On the other hand, the deterioration of the oxide film can occur due to the oxidation or reduction of the oxide during the temperature-elevating stage of the finishing annealing, if the formation temperature of the glass film is high. If the deterioration of the oxide film occurs, the glass film formed due to reaction between the oxide, particularly $SiO_2$, and MgO, will not have the required excellent properties.

The reasons for the non-deterioration of the oxide film are believed to be as follows.

The antimony sulfate is melted during the drying of the annealing separator or the temperature-elevating stage of the finishing annealing and forms a dense Sb film on the surface of a steel sheet. The so-formed dense Sb film protects the oxide film components, such as $SiO_2$ and fayalite, formed during the decarburization annealing from the gas atmosphere of the finishing annealing. If the inhibitor elements of the steel sheet are removed from the steel sheet or added from the gas atmosphere into the steel sheet during the temperature-elevating stage of the finishing annealing, the secondary recrystallization may be unstabilized. When the $N_2$-containing gas atmosphere is used in the finishing annealing, $N_2$-absorption and S-removal are likely to occur. The Sb film strengthens the sealing function of the films of MgO, $SiO_2$ and the like and prevents the removal and absorption of the inhibitor elements.

The chloride is melted during the drying of the annealing separator or the temperature-elevating stage of the finishing annealing and is reacted in the molten state, with the oxide film formed during the decarburization annealing. The chloride decreases the FeO content and increases the $SiO_2$ content in the oxide film, which greatly contributes to the improvement in the magnetic properties, especially the watt loss, and in the properties of the glass film.

The process for producing a grain-oriented electrical steel sheet is described hereinafter in detail.

First, the composition of a hot-rolled strip for producing a grain-oriented electrical steel sheet (hereinafter referred to as the hot-rolled strip) is explained.

If the C content of the hot-rolled strip is less than 0.03%, failure of the secondary recrystallization occurs. On the other hand, a C content of the hot-rolled strip of more than 0.100% is disadvantageous in the light of the decarburization and magnetic properties. The C content of the hot-rolled strip, therefore, should be from 0.03 to 0.100%.

Silicon (Si) is a fundamental alloying element for determining the watt loss. If the Si content of the hot-rolled strip is less than 2.5%, the watt loss would not be low. On the other hand, if the Si content of the hot-rolled strip is more than 4.0%, the cold-rolling workability is greatly reduced. The Si content of the hot-rolled strip, therefore, should be from 2.5 to 4.0%.

In addition to C and Si, the hot-rolled strip contains Mn, S, Cu, Al, N, and the like for forming the sulfide and nitride which act as the inhibitors. The contents of Mn, S, Cu, Al and N are not specifically restricted, but the preferred contents are as follows: Mn—0.03~0.20%; S—0.01~0.05%; Al—from 0.01 to 0.06% in terms of the acid-soluble Al; N—from 0.003 to 0.012%; and Cu—from 0.05 to 0.30%. Either nitride or sulfide or both nitride and sulfide can be used as the inhibitor.

If necessary, one or more of Sn, Sb, Se, Cr, Ni, Mo, and other alloying elements may be contained in the hot-rolled strip.

Next, the process for treating and forming the hot-rolled strip is explained.

The hot-rolled strip is annealed, if necessary, and is then cold-rolled once or is cold-rolled twice or more with an intermediate annealing. The thickness of the cold-rolled strip is, for example, from 0.15 to 0.35 mm, depending upon the gauge thickness of the grain-oriented electrical steel sheet.

The cold-rolled strip is decarburization-annealed in a gas atmosphere consisting of wet hydrogen and nitrogen. During the decarburization annealing, the carbon of the cold-rolled strip is removed and the oxide film comprising $SiO_2$ is formed on the surface of the cold-rolled strip.

The annealing separator according to the present invention, comprising from 0.05 to 2.0 parts by weight of antimony sulfate based on 100 parts by weight of magnesium oxide, is applied on the decarburization annealed strip. When the weight part of antimony sulfate is less than 0.05, the magnetic properties are not improved. On the other hand, when the weight part of antimony sulfate is more than 2.0 parts by weight, the appearance of the glass film and the magnetic properties are impaired. According to the present invention, at least one chloride selected from the group consisting of Sb, Sr, Ti, and Zr chlorides is added such that chlorine is contained in an amount of from 5 to 20% by weight based on 100% of the chlorides and antimony sulfate, to ensure an improvement in the magnetic properties and of the properties of the glass film. If the content of the at least one chloride is less than 5%, the magnetic properties are not effectively improved and the FeO content in the oxide film is not effectively reduced, due to the etching function of the chloride. On the other hand, if the content of the at least one chloride is more than 20%, the chloride remains up to a high temperature-region of the finishing annealing, and causes color-change and irregularity of the glass film (referred to as the gas-mark) to occur, especially when the gas-permeability between the sheet sections is poor, or when the furnace atmosphere causes oxidation due to a high content of hydration water. Both the improved magnetic properties and properties of the glass film are attained at the chloride amount of from 5 to 20% by weight.

The annealing separator may additionally comprise Ti oxide in an amount of from 0.5 to 10 parts by weight based on 100 parts by weight of MgO, so as to improve the properties of the glass film and to mitigate the embrittlement of the steel sheet. If the content of Ti oxide is less than 0.5 part by weight, the Ti oxide is not effective for improving the properties of the glass film and for mitigating the embrittlement of the steel sheet. On the other hand, if the content of Ti oxide is more than 10% by weight, a Ti compound, such as nitride, is formed on the steel sheet during the temperature elevation stage of the finishing annealing. The thus formed Ti-nitride film, or the like is positioned beneath the glass film and is liable to exert a detrimental influence such as deterioration of the magnetic properties.

The annealing separator is mixed with water or other dispersion media and is then applied on the steel sheet. The application amount of the annealing separator is usually 5~10 g per $m^2$ of the steel sheet.

The present invention is further explained by reference to the following Examples.

EXAMPLE 1

A slab containing 3.15% of Si, 0.068% of Mn, 0.023% of S, and 0.045% of C, the balance being Fe and unavoidable impurities, was subjected to a known process of hot-rolling, pickling, cold-rolling, annealing, and cold-rolling to deform the slab into a 0.29 mm thick strip. This strip was decarburization-annealed at 840° C. for 2 minutes in a wet $N_2+H_2$ atmosphere. The annealing separators were prepared by 100 weight parts of MgO, antimony sulfate $Sb_2(SO_4)_3$ in the weight parts given in Table 1, and antimony chloride $SbCl_3$.

The antimony chloride $SbCl_3$ in an amount of 5, 10, 15, and 20% by weight, was preliminary mixed with antimony sulfate $Sb_2(SO_4)_3$, and the antimony sulfate $Sb_2(SO_4)_3$ mixed with antimony chloride $SbCl_3$ was then mixed with MgO. The annealing separators were applied on the sections of the decarburization annealed strip at an amount of 6.5 g per $m^2$ of one surface of the sections. After drying the annealing separator, the finishing annealing was carried out at 1200° C. for 20 hours.

The magnetic properties of the grain-oriented electrical steel sheets and the properties of the glass film are shown in Table 1.

TABLE 1

| Amount of Cl contained in $Sb_2(SO_4)_3$. $SbCl_3$ (wt %) | Weight part of $Sb_2(SO_4)_3$ relative to 100 weight part of MgO | Magnetic Properties $B_{10}$ (T) | Magnetic Properties $W_{17/50}$ (w/kg) | Appearance of glass film * |
|---|---|---|---|---|
| 0 | 0 | 1.855 | 1.21 | Δ |
| 5 | 0.25 | 1.275 | 1.15 | ⊚ |
| | 0.5 | 1.867 | 1.14 | ⊚ |
| | 1.0 | 1.865 | 1.16 | ○ |
| | 2.0 | 1.860 | 1.18 | ○ |
| 10 | 0.25 | 1.870 | 1.15 | ⊚ |
| | 0.5 | 1.873 | 1.15 | ⊚ |
| | 1.0 | 1.858 | 1.17 | ○ |
| | 2.0 | 1.850 | 1.18 | ○ |
| 15 | 0.25 | 1.869 | 1.16 | ⊚ |
| | 0.5 | 1.868 | 1.17 | ○ |
| | 1.0 | 1.868 | 1.17 | ○ |
| | 2.0 | 1.859 | 1.18 | ○ |
| 25 | 0.25 | 1.860 | 1.19 | ○ |
| | 0.5 | 1.850 | 1.22 | Δ |
| | 1.0 | 1.842 | 1.24 | x |
| | 2.0 | 1.840 | 1.25 | x |

*Criterion of Appearance of Glass Film
⊚: Good, uniform, and no irregularities
○: Good, but slightly thin
Δ: Relatively thin and irregular
x: Failure. Thin and irregular

EXAMPLE 2

A slab containing 0.065% of C, 3.25% of Si, 0.028% of Al, 0.08% of Cu, 0.10% of Sn, 0.024% of S, and 0.0080% of N, the balance being Fe an unavoidable impurities, was subjected to a known process of hot-rolling, annealing of the hot-rolled strip, pickling, and cold-rolling, to deform the slab into a 0.225 mm thick strip. This strip was decarburization annealed at 840° C. for 2 minutes in a wet $N_2+H_2$ atmosphere. The annealing separators were prepared by 100 weight parts of MgO, 5 weight parts of $TiO_2$, antimony sulfate $Sb_2(SO_4)_3$ in the weight parts given in Table 2, and antimony chloride $SbCl_3$.

The antimony chloride $SbCl_3$ in an amount of 5, 10, 15, and 25% by weight was preliminary mixed with antimony sulfate $Sb_2(SO_4)_3$, and the antimony sulfate $Sb_2(SO_4)_3$ mixed with antimony chloride $SbCl_3$ was then mixed with MgO. The annealing separators were applied on the sections of the decarburization annealed strip at an amount of 7 g/$m^2$ of one side of the sections. After drying the annealing separator, the finishing annealing was carried out at 1200° C. for 20 hours.

The magnetic properties of the grain-oriented electrical steel sheets and the properties of the glass film are shown in Table 2.

TABLE 2

| Amount of Cl contained in $Sb_2(SO_4)_3$. $SbCl_3$ (wt %) | Weight part of $Sb_2(SO_4)_3$ relative to 100 weight part of MgO | Magnetic Properties $B_{10}$ (T) | Magnetic Properties $W_{17/50}$ (w/kg) | Appearance of glass film * |
|---|---|---|---|---|
| 0 | 0 | 1.915 | 0.97 | Δ |
| 5 | 0.25 | 1.935 | 0.90 | ◎ |
| | 0.5 | 1.948 | 0.84 | ◎ |
| | 1.0 | 1.955 | 0.82 | ○ |
| | 2.0 | 1.939 | 0.92 | ○ |
| | 3.0 | 1.927 | 0.99 | Δ |
| 10 | 0.25 | 1.943 | 0.86 | ◎ |
| | 0.5 | 1.957 | 0.82 | ◎ |
| | 1.0 | 1.949 | 0.88 | ○ |
| | 2.0 | 1.940 | 0.93 | ○ |
| | 3.0 | 1.920 | 0.99 | Δ |
| 15 | 0.25 | 1.940 | 0.89 | ◎ |
| | 0.5 | 1.942 | 0.87 | ◎ |
| | 1.0 | 1.933 | 0.93 | ○ |
| | 2.0 | 1.929 | 0.95 | ○ |
| | 3.0 | 1.916 | 1.02 | x |
| 25 | 0.25 | 1.938 | 0.90 | Δ |
| | 0.5 | 1.939 | 0.93 | Δ |
| | 1.0 | 1.930 | 0.95 | x |
| | 2.0 | 1.922 | 0.98 | x |
| | 3.0 | 1.905 | 1.04 | x |

*Criterion of Appearance of Glass Film
◎: Good, uniform, and no irregularities
○: Good, but slightly thin
Δ: Relatively thin and irregular
x: Failure. Thin and irregular

EXAMPLE 3

The decarburization annealed strip was prepared as in Example 1.

The annealing separators were prepared by 100 weight parts of MgO, 5 weight parts of $TiO_2$, antimony sulfate $Sb_2(SO_4)_3$ in the weight parts given in Table 1, and at least one chloride selected from the group consisting of Sr, Ti, and Zr chlorides. This chloride in an amount of 5% by weight was preliminary mixed with antimony sulfate $Sb_2(SO_4)_3$, and the antimony sulfate $Sb_2(SO_4)_3$ mixed with the chloride was then mixed with MgO. The annealing separators were applied on the sections of the decarburization-annealed strip at an amount of 6.5 g per $m^2$ of one surface of the sections.

The magnetic properties and the properites of the glass film are shown in Table 3.

TABLE 3

| Weight proportion of chlorides Sr | Ti | Zr | Amount of Cl contained in $Sb_2(SO_4)_3$. chloride (wt %) | Weight part of $Sb_2(SO_4)_3$+chloride relative 100 weight parts of MgO | Magnetic Properties $B_{10}$ (T) | Magnetic Properties $W_{17/50}$ (w/kg) | Appearance of glass film * |
|---|---|---|---|---|---|---|---|
| 0 | 0 | 0 | 0 | 0 | 1.925 | 0.96 | ○ |
| 3 | 0 | 0 | | | 1.945 | 0.87 | ◎ |
| 2 | 1 | 0 | | | 1.940 | 0.88 | ◎ |
| 1 | 2 | 0 | 5 | 0.5 | 1.932 | 0.91 | ◎ |
| 0 | 3 | 0 | | | 1.929 | 0.93 | ◎ |
| 0 | 0 | 3 | | | 1.948 | 0.89 | ◎ |
| 0 | 1 | 2 | | | 1.947 | 0.88 | ◎ |

*Criterion of Appearance of Glass Film
◎: Good, uniform, and no irregularities
○: Good, but slightly thin

We claim:

1. A process for producing a grain-oriented electrical steel sheet having both improved magnetic properties and properties improved glass film wherein a hot-rolled steel strip containing from 0.030 to 0.100 wt % of C, from 2.5 to 4.0 wt % of Si, and either or both of a sulfide and a nitride as an inhibitor against growth of primary grains is, if necessary annealed, and cold-rolled once or twice or more with an intermediate annealing, to obtain a final gauge, a decarburization annealing is thereafter carried out, resulting in formation of an oxide film comprising $SiO_2$ on the surface of the steel sheet an annealing separator mainly comprising MgO is applied on the oxide film, and, a finishing annealing is thereafter carried out, characterized in that the annealing separator further comprises from 0.05 to 2.0 parts by weight of antimony sulfate based on 100 parts by weight of the magnesium oxide, and at least one chloride selected from the group consisting of Sb, Sr, Ti, and Zr chlorides in a chlorine amount of from 5 to 20% by weight based on 100% of the chlorides and the antimony sulfate.

2. A process according to claim 1, wherein the annealing separator still further comprises from 0.5 to 10 parts by weight of $TiO_2$.

3. The process according to claim 1 or 2, wherein said at least one chloride is an Sb chloride.

* * * * *

UNITED STATES PATENT AND TRADEMARK OFFICE

CERTIFICATE OF CORRECTION

PATENT NO. : 4,543,134

DATED : September 24, 1985

INVENTOR(S) : Osamu Tanaka et al.

It is certified that error appears in the above-identified patent and that said Letters Patent is hereby corrected as shown below:

Column 3, line 5, "$Sb_2(SO_4)_3.SbCl_3.$" should read --$Sb_2(SO_4)_3 \cdot S_bCl3$.--

Column 3, line 26, same change as in Column 3, line 5.

Column 3, line 31, same change as in Column 3, line 5.

Column 6, line 21, "$Sb_2(SO_4)_3.$" should read --$Sb_2(SO_4)_3$.--.

Column 6, line 46, "Fe an" should read -- Fe and --.

Column 7, line 5 (Table 2), same change as in Column 6, line 21 (Table 1).

Column 7, line 27, "): Good" should read -- O: Good --.

UNITED STATES PATENT AND TRADEMARK OFFICE

CERTIFICATE OF CORRECTION

PATENT NO. : 4,543,134

DATED : September 24, 1985

INVENTOR(S) : Osamu Tanaka et al

It is certified that error appears in the above-identified patent and that said Letters Patent is hereby corrected as shown below:

Column 8, line 23, "properties improved glass film" should read -- improved glass film properties, --.

Column 8, line 32, after "sheet" insert --,--.

Column 8, Table 3 (second column), "$Sb_2(SO_4)_3$." should read -- $Sb_2(SO_4)_3$. --.

Signed and Sealed this

*Tenth* Day of *June 1986*

[SEAL]

*Attest:*

*Attesting Officer*

DONALD J. QUIGG

*Commissioner of Patents and Trademarks*